US006682418B1

(12) United States Patent
Mendes et al.

(10) Patent No.: US 6,682,418 B1
(45) Date of Patent: Jan. 27, 2004

(54) ARCADE GAME WITH LIGHT EMITTING RACE PROGRESS INDICATOR

(75) Inventors: John F. Mendes, Ormond Beach, FL (US); Weimar P. Tudela, Orlando, FL (US); David A. Wise, Daytona Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 114 days.

(21) Appl. No.: 09/680,681

(22) Filed: Oct. 6, 2000

Related U.S. Application Data

(60) Provisional application No. 60/165,963, filed on Nov. 17, 1999.

(51) Int. Cl.[7] ..... A63F 13/00

(52) U.S. Cl. ..... 463/6; 273/349; 273/445; 463/59; 463/46; 463/31

(58) Field of Search ..... 273/371, 349, 273/445; 463/58–60, 6, 31, 2, 7

(56) References Cited

U.S. PATENT DOCUMENTS

| | | | | | |
|---|---|---|---|---|---|
| 2,028,676 | A | * | 1/1936 | Light | 273/371 |
| 2,507,916 | A | * | 5/1950 | Lister | 250/559.42 |
| 2,627,411 | A | * | 2/1953 | Bartlam et al. | 463/60 |
| 2,759,731 | A | | 8/1956 | Quinn | 273/349 |
| 3,336,030 | A | | 8/1967 | Martell et al. | 273/349 |
| 3,342,492 | A | | 9/1967 | Barrett | 273/349 |
| 3,362,713 | A | | 1/1968 | Miller | 273/349 |
| 3,572,712 | A | * | 3/1971 | Vick | 463/60 |
| 4,040,622 | A | | 8/1977 | Sinnott | 273/349 |
| 4,333,657 | A | * | 6/1982 | Jaworski et al. | 273/368 |
| 4,927,160 | A | * | 5/1990 | Nichol et al. | 273/118 A |
| 4,949,972 | A | * | 8/1990 | Goodwin et al. | 250/553 |
| 5,020,806 | A | * | 6/1991 | Martin | 273/371 |
| 5,439,230 | A | * | 8/1995 | Mendes, Jr. | 273/349 |
| 5,566,950 | A | * | 10/1996 | Senna | 463/60 |
| 5,573,243 | A | * | 11/1996 | Bartosik | 463/60 |
| 5,595,387 | A | * | 1/1997 | Senna | 273/369 |
| 6,007,429 | A | * | 12/1999 | Lubniewski | 273/371 |
| 6,579,174 | B1 | * | 6/2003 | Lane et al. | 463/6 |

* cited by examiner

*Primary Examiner*—Jessica Harrison
*Assistant Examiner*—Corbett B Coburn
(74) *Attorney, Agent, or Firm*—Standley Law Group LLP

(57) ABSTRACT

A game in which a player shoots water, air, light, a missile, or any other suitable projectile at a target. The target is activated when it is hit by the projectile. Activation of the target causes a plurality of lights to emit light in a predetermined order. The player wins the game by causing all of the lights to emit light.

17 Claims, 13 Drawing Sheets

ARCADE GAME WITH LIGHT EMITTING RACE PROGRESS INDICATOR

This application claims the benefit of U.S. Provisional Application No. 60/165,963, filed Nov. 17, 1999. In addition, this application hereby incorporates by reference the subject matter of U.S. Pat. No. 5,439,230 to John F. Mendes, Jr.

BACKGROUND AND SUMMARY OF THE INVENTION

The present invention relates to the general field of arcade games, and more particularly, an arcade game having interchangeable modules or features.

The present invention is a game that involves players shooting water, air, light or any other suitable means at a target where activation of the target causes the progression of a race progression indication device or means (e.g., an entire column may rise, an object on a vertical or horizontal plane may move, water may rise up a column, a progression of lights may be illuminated, etc.). The first player whose race progression indication device reaches a predetermined level or point is deemed the winner of the game (e.g., a column rises to a predetermined point or all the lights on a column are illuminated). The present game is unique over known columnar games in that the game of the present invention is adapted to be interchanged into many different games or into distinct variations of the same game. For example, the base unit of the game may be fitted with various race progression indication devices (i.e., devices that show the progress of a particular player in the race) and/or winner indication devices (i.e., devices that indicate the winner of the game or race) to form various arcade games. For example, one arcade unit may be used to form:

a) a race game where the entire column rises to a predetermined level and where the winner's column has a ring of light that glows to indicate the winner; or b) a race game where the entire column rises to a predetermined level and where the winner's column has a round platform affixed to it which rotates (i.e., spins) to indicate the winner; or c) a race game having a stationary column where the column is comprised of a plurality of lights or disks of lights placed along the length of the column and where the lights are progressively illuminated to indicate race progress (i.e., as the target is hit by a player, more lights are illuminated until one player illuminates all of the lights of his column, thus winning the race); or d) a water race game having a stationary column which is progressively filled with water to indicate race progression, where the player to first fill his column with water is deemed the winner of the race (details of such a water game are disclosed in U.S. Pat. No. 5,439,230 to Mendes, Jr. which has been incorporated by reference).

A preferred base unit of the game of the present invention is pre-wired to accommodate any one or more of the games indicated above. With the wiring of all accommodated games in place in the unit, the particular race progression indication device and/or winner indication device may be placed into the base unit and wired to the corresponding wire connections in the base unit to form a particular game. If another game, or a variation of the same game, is desired, the installed race progression indication device and/or winner indication device may be replaced with another race progression indication device and/or winner indication device to form another game. For example, instead of having a top platform that glows to indicate a winner, the column may be fitted with a spinning platform that spins to indicate the winner. For another example, instead of having a rising column to indicate the progress of the player in a race, a stationary column with rising water may be used to indicate the progression of the player in the race.

The interchangeability of the present invention provides a flexible arcade game that may be configured for many different games. This "plug-and-play" feature allows the owner of the game to swiftly alter the unit to form a different game or a variation of the same game. By providing the ability to change the type of game or features of the game, players are given an opportunity to experience various types of games, and/or they may choose to play a particular game that they find most enjoying. The owner of the game may configure the game to achieve the design that he or she believes will attract the most interest and players.

One embodiment of the present invention is a game comprising a projectile device, an activation device, and a game progression indication device. The projectile device is adapted to shoot at least one projectile, and the activation device is adapted to activate a signal when hit by the at least one projectile. The game progression indication device is in electrical communication with the activation device. The game progression indication device is comprised of a plurality of lights, wherein the game is configured to cause the lights to emit light in succession in response to the signal.

The at least one projectile may be any suitable projectile such as, but not limited to, a fluid (e.g., water or air), a solid, a light beam, or any other similar projectile. The activation device may be any device that can perform the desired function. For example, the activation device may be any suitable device such as a switch, e.g., an electronic switch, a mechanical switch, or an optical switch, or any other similar device. It is also appreciated that other suitable embodiments of the activation device include, but are not limited to, a laser sensor, a pressure sensor, an electrical contact, or any other similar device.

The lights of the game progression indication device may be arranged in any desired order. For example, the lights may be arranged in a column. More particularly, the lights may be arranged in a plurality of generally horizontal rows, and the rows may be stacked in a generally vertical direction. In such an embodiment, the game may be configured to cause the rows of the lights to emit light in succession, or any other desired progressive fashion, in response to the signal.

The lights may be any desired type of light emitting device. For example, the lights may be LEDs.

The game may further comprise a processing system such as, but not limited to, a microcontroller or microprocessor-based system or any other suitable type of system. The processing system may be interposed between the activation device and the game progression indication device. The processing system is preferably adapted to control the lighting of the lights in response to the signal. For example, the processing system can be used to control the power supplied to the lights.

Another embodiment of the present invention is a game that includes a projectile device adapted to shoot at least one projectile, and an activation device adapted to activate at least one trigger signal when hit by the at least one projectile. A processing system is in electrical communication with the activation device. The processing system is adapted to process the at least one trigger signal and produce at least one game progression signal. A game progression indication device is in electrical communication with the processing system, and it is comprised of a plurality of lights. In this embodiment, the at least one game progression signal from the processing system is adapted to cause the lights to emit light in a predetermined order, e.g., in succession or another progressive fashion. This embodiment of the present invention may include any of the optional or preferred features of the previous embodiment of the present invention.

The present invention also includes a game comprising an activation device adapted to be activated by a player, and a game progression indication device connected to the activation device. The game progression indication device is comprised of a plurality of lights, wherein the game is configured to cause the lights to emit light in a progressive fashion in response to activation of the activation device. A player can win the game by causing all of the lights to emit light. This embodiment of the game may include any of the optional or preferred features of the above-described embodiments of the present invention.

In addition to the novel features and advantages mentioned above, other objects and advantages of the present invention will be readily apparent from the following descriptions of the drawings and preferred embodiments.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAIL DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

The present game is unique over known columnar games in that the game of the present invention is adapted to be interchanged into many different games or distinct variations of the same game. For example, the base unit of the game may be fitted with various race progression indication devices (i.e., devices that show the progress of a particular player in the race) and/or winner indication devices (i.e., devices that indicate the winner of the game or race) to form various arcade games. For example, one arcade unit may be used to form:

a) a race game where the entire column rises to a predetermined level and where the winner's column has a ring of light that glows to indicate the winner; or b) a race game where the entire column rises to a predetermined level and where the winner's column has a round platform affixed to it which rotates (i.e., spins) to indicate the winner; or c) a race game having a stationary column where the column is comprised of a plurality of lights or disks of lights placed along the length of the column and where the lights are progressively illuminated to indicate race progress (i.e., as the target is hit by a player, more lights are illuminated until one player illuminates all of the lights of his column, thus winning the race); or d) a water race game having a stationary column which is progressively filled with water to indicate race progression, where the player to first fill his column with water is deemed the winner of the race (details of such a water game are disclosed in U.S. Pat. No. 5,439,230 to Mendes, Jr. which has been incorporated by reference).

The following paragraphs describe one alternative embodiment of the present invention as a rising column race game. The subsequent paragraphs will describe how such one alternative embodiment may be changed, according to the present invention, to another alternative game embodiment.

Figure 1:
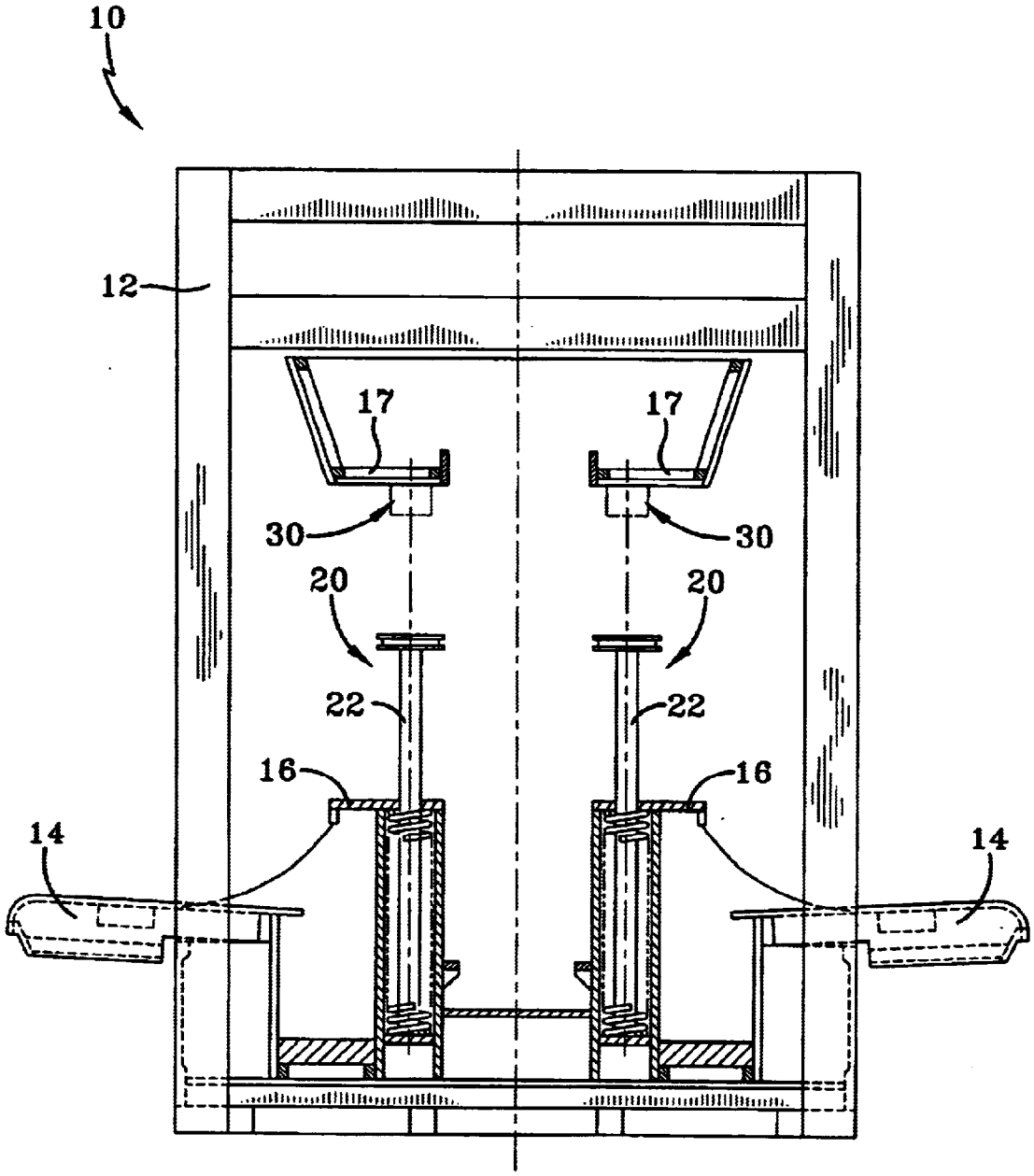
FIG. 1 illustrates an end elevational view of one embodiment of a columnar race game.

FIG. 1 illustrates a detailed, end elevational view of one embodiment of a columnar race embodiment 10 of the present invention. The dimensions are indicated in FIG. 1 only for exemplary purposes. It should be recognized that the columnar race embodiment 10 may have any desired dimensions.

Figure 2:
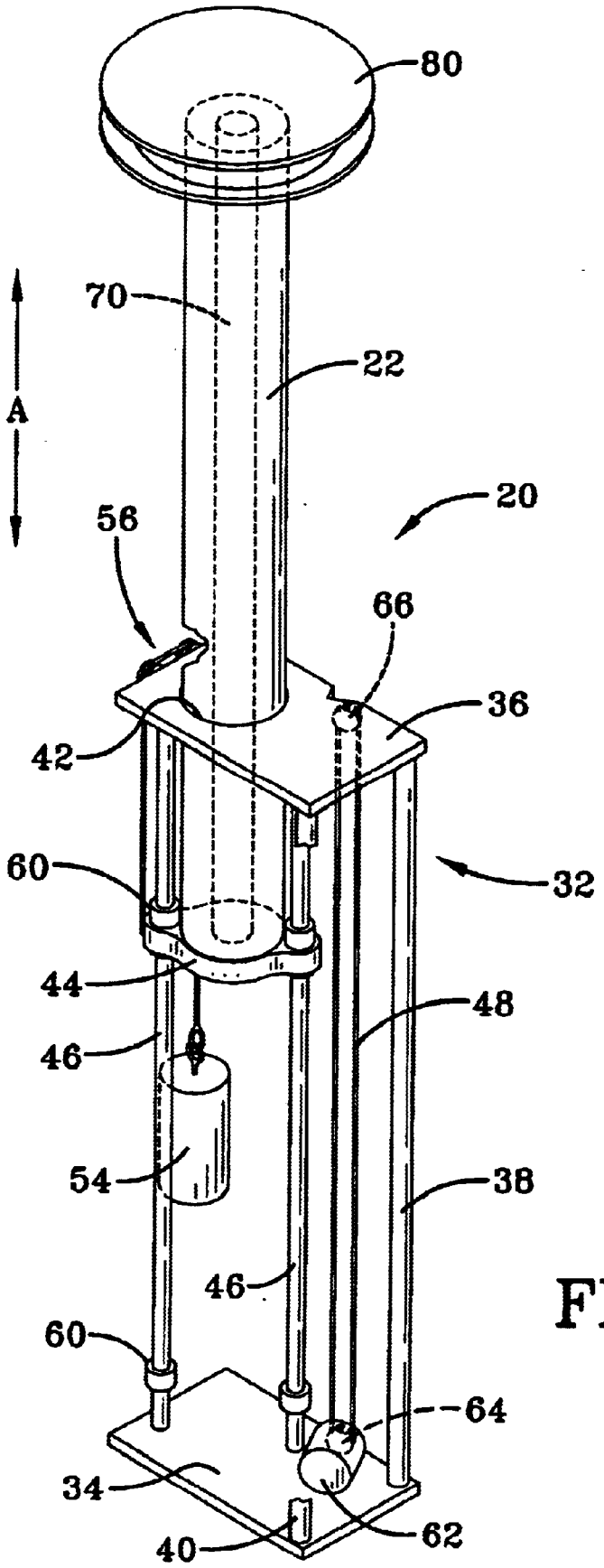
FIG. 2 illustrates one embodiment of a column structure of a rising column game of the present invention.

Referring to FIG. 1, the game is generally supported and resides in a structure having a frame 12. The structure is preferably comprised of at least one game console 14, at least one game cabinet 16, at least one top ledge 17, and a roof. The columnar game embodiment of the present invention preferably includes a plurality of column structures 20, each having a movable column 22. FIG. 2 illustrates one embodiment of a column structure 20 of the present invention. The columns 22 are preferably adapted for movement in the vertical direction illustrated by arrow A. The object of the game is to fire a gun or any other suitable projectile device to hit a target, or activation device, located on a game cabinet 16. Hitting the target a predetermined number of times and/or for a predetermined amount of time causes actuation of a column 22 in the vertical direction from a down position to an up position. The first player having his or her column 22 reach the up position is the winner of the game. The players are preferably seated around the consoles 14 of the game structure (seats not shown in the FIG. 1).

Figure 14:
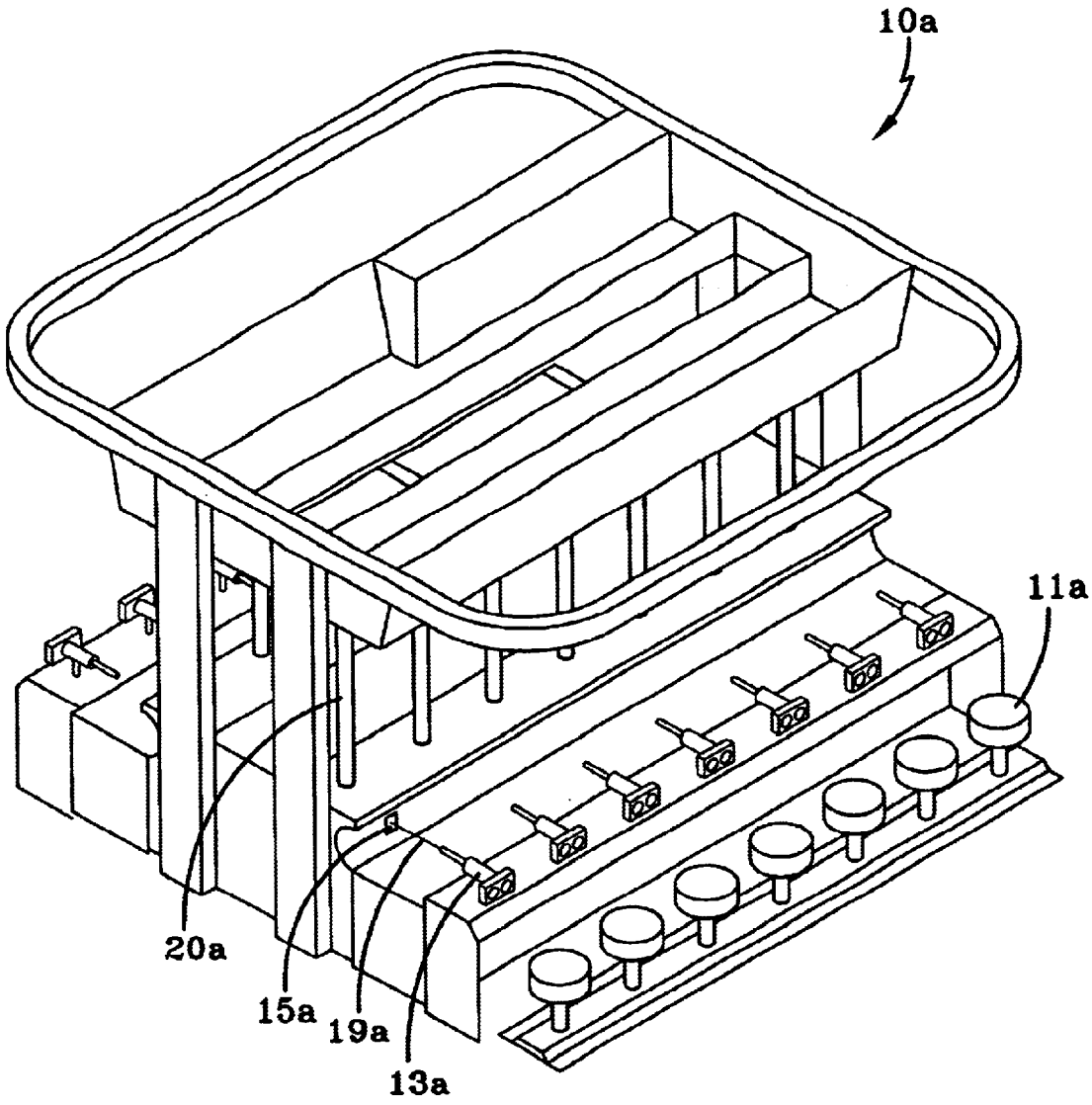
FIG. 14 is a perspective view of an alternative embodiment of a columnar race game.

FIG. 14 is a perspective view of an alternative columnar race embodiment 10*a* that more clearly shows certain aspects of the game. Multiple players can be seated on seats 11*a* which are located on opposing sides of the structure. The game 10*a* includes a plurality of column structures 20*a*. The game 10*a* also includes a plurality of projectile devices 13*a* and targets 15*a*. A projectile device 13*a* may be a gun or any other suitable device, and it is preferably adapted to shoot a projectile 19*a* at a respective target 15*a*. The projectile 19*a* is preferably a fluid such as, but not limited to, water or air. However, it should be recognized that the projectile may also be light, e.g., a laser beam, or a solid, e.g., a ball, a bullet, or a missile, or any other suitable projectile. As noted above, the object of this embodiment 10*a* is to cause a column of a column structure 20*a* to be the first to rise to an up position by hitting the target 15*a* with the projectile 19*a*.

It is appreciated that various types of targets or activation devices may be used. Activation devices may be formed with electronic switches, mechanical switches, optical switches, laser sensors, pressure sensors, electrical contacts, or any other device adapted to send an activation signal for controlling movement of a column 22. In a preferred embodiment, the activation device sends an electrical signal to a processing device that controls movement of the column 22. As an example, commercially available switches are available from Microswitch, Inc.

The device used to activate the activation device may vary. For example, a water gun may be used. In other embodiments, a laser gun, an air gun, or a projectile gun may be used. In a preferred embodiment, the guns are connected to the consoles 14 such that one gun is positioned in front of each of the targets or activation devices.

Detection devices are used in relation to each of the columns 22 for detecting when a column has reached the uppermost position. The detection devices are preferably placed on the top ledge 17 or the cabinet 16 of the game structure. A detection device may be a switch, e.g. a microswitch, or any other suitable device that is adapted to activate a signal when tripped or otherwise made active. For example, a contact switch may be placed in relation to the column structure 20 so that the column 22 activates the switch once the column 22 reaches the uppermost position. The detection device may signal another device that indicates the winner of the game. For example, flashing lights 30 may be placed in relation to each of the columns 22 to indicate a winner of the game. The detection device, when activated, preferably sends a signal to a processing system. The processing system determines which detection device was activated first and actuates the flashing lights 30 corresponding to the winner and stops the game. The processing system may be any microcontroller or microprocessor-based system adapted to accept signals from multiple detection devices. It is appreciated that other "win" indication devices may be used such as alarms, sirens, spinning tops, glowing tops, lighted LEDs in predetermined patterns, etc.

Figure 3C:
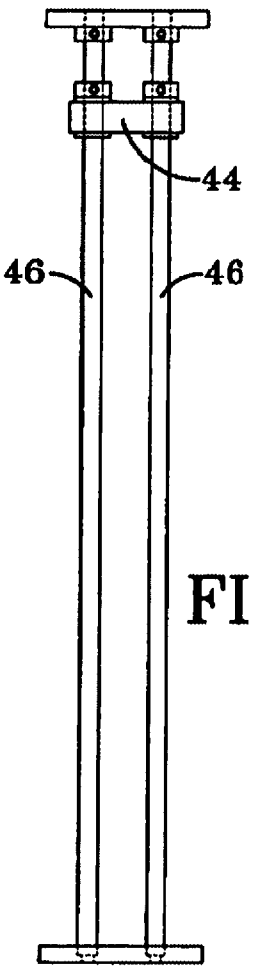
FIGS. 3A–3C illustrate various views of one embodiment of a slide assembly of a rising column game of the present invention.
Figure 3B:
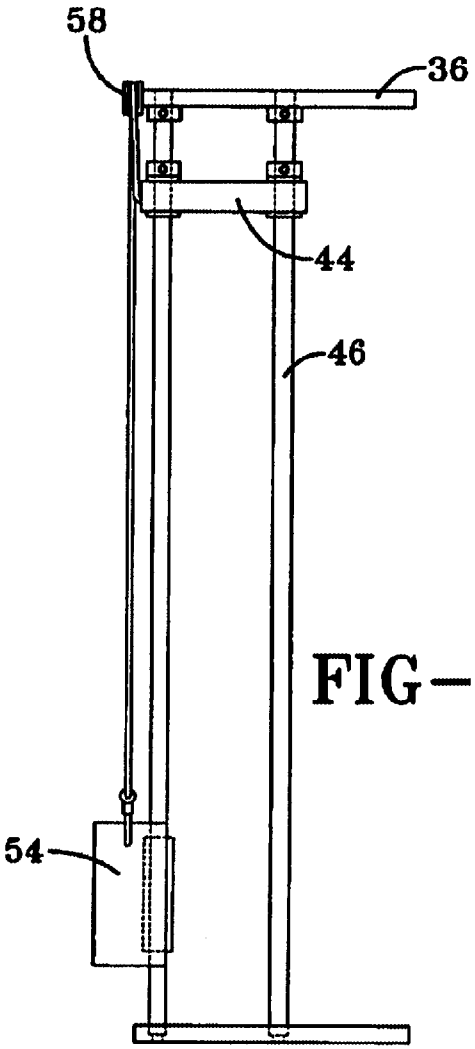
Figure 3A:
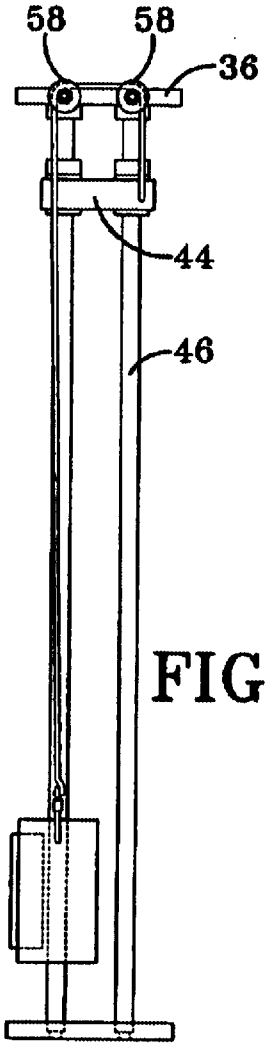

Referring to FIG. 2, one embodiment of the column structure 20 of the present invention is comprised of a column 22 movable in the vertical direction. The column 22 is supported in the vertical position by a frame structure shown generally at 32. The frame structure 32 of the embodiment of FIG. 2 is comprised of a lower stand 34, an upper stand 36, and a first and second upright 38 and 40. The upper stand 36 has a hole 42 in which the column 22 is disposed. In the embodiment of FIG. 2, the column 22 is attached to a slide assembly 44. The slide assembly 44 is movably attached to two slide rods 46. FIGS. 3A–3C illustrate various views of the slide assembly 44 movably attached to the slide rods 46. The slide assembly 44 has a large recess or opening for engaging the column 22 and two smaller openings for engaging the slide rods 46.

In the embodiment of FIG. 2, the column 22 is moved in the vertical direction by a wire or chain 48 connected to the slide assembly 44. The chain 48 is connected to a motor 62. More specifically, the chain 48 in this embodiment is connected to a bottom sprocket 64 and an upper sprocket 66. In the embodiment of FIG. 2, the chain 48 is connected to a plate of the slide assembly 44. The motor 62 actuates the chain 48 which causes the slide assembly 44 and column 22 to move in the vertical direction. In one embodiment, the motor 62 is a bi-directional rotary stepper motor which causes the chain 48 to move in one direction when the motor moves in a first direction and causes the chain 48 to move in an opposite direction when the motor 62 moves in a second direction. However, it should be appreciated that various other types of motors and means may be used to move the columns 22.

In one embodiment, a counterbalance 54 may be attached to the slide assembly 44, e.g., by using a pulley system 56. The counterbalance 54 preferably reduces the power needed to move the column 22 in the vertical direction. The pulleys 58 may be attached to the upper stand 36. In one embodiment, stops 60 are placed on predetermined portions of the slide rods 46 to prevent further movement of the column 22 past the stops 60.

Figure 4:
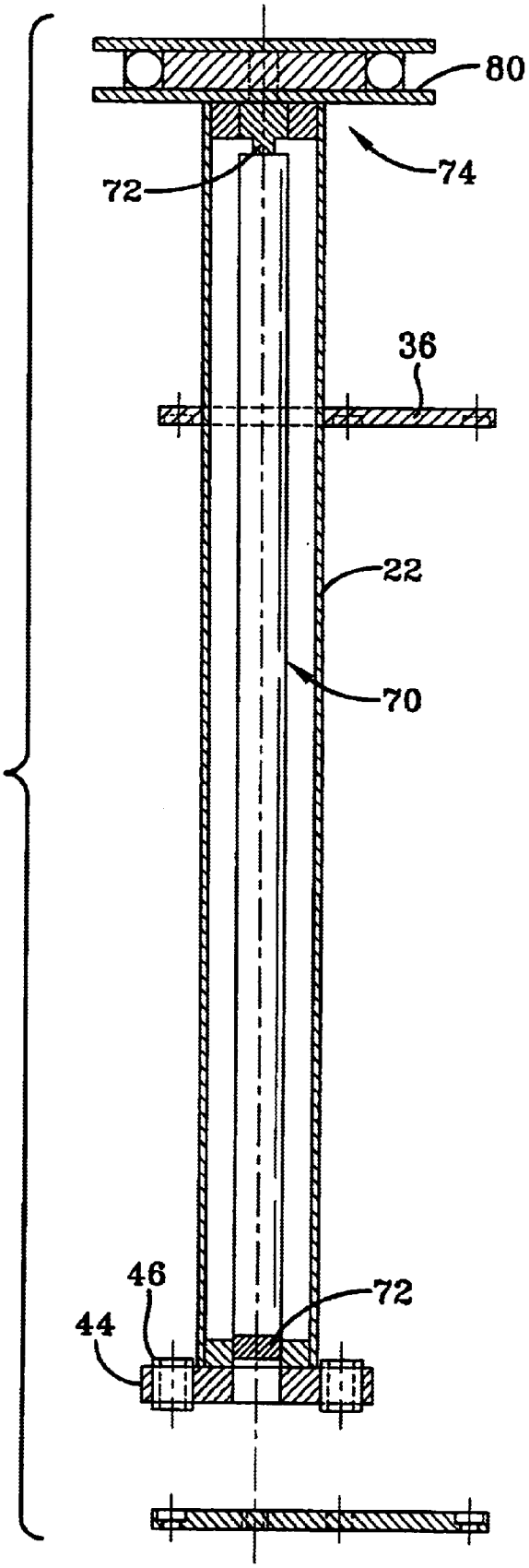
FIG. 4 illustrates one embodiment of a light disposed within a column of a rising column game of the present invention.

In the rising column embodiment of FIG. 2, a light 70 may be disposed in the transparent column 22. FIG. 4 illustrates one embodiment of a light 70 disposed within the column 22. The light 70 is preferably fluorescent. As illustrated, electrical sockets 72 are placed at interior ends 74 of the column 22, and the light 70 is disposed along the length of the column 22. The light 70 provides an aesthetically pleasing look while providing light to the game.

In the embodiment of the rising column of FIG. 2, a crown assembly or platform 80 is placed at a top end of the column 22. A neon light may be placed around the platform 80. The platform 80 is preferably substantially flat which allows the placement of a prize or other ornament on the platform 80. As discussed, according to the present invention, the glowing platform may be interchanged with a spinning platform that indicates the winner of the game.

It is appreciated in light of the foregoing description and the drawings that features of the rising column structure 20 of the present invention may be varied without departing from the spirit of the invention. For example, the column 22 may be of various shapes such as a tubular, rectangular, or any other elongated shape. A pulley system may be used to power the column 22 in the vertical direction as opposed to the chain embodiment. The slide assembly 44 may be configured in different shapes and may be movably connected in various other ways. The range of movement of the column 22 may be varied based on the length of the slide rods 46 and the location of the stops 60.

Figure 5:
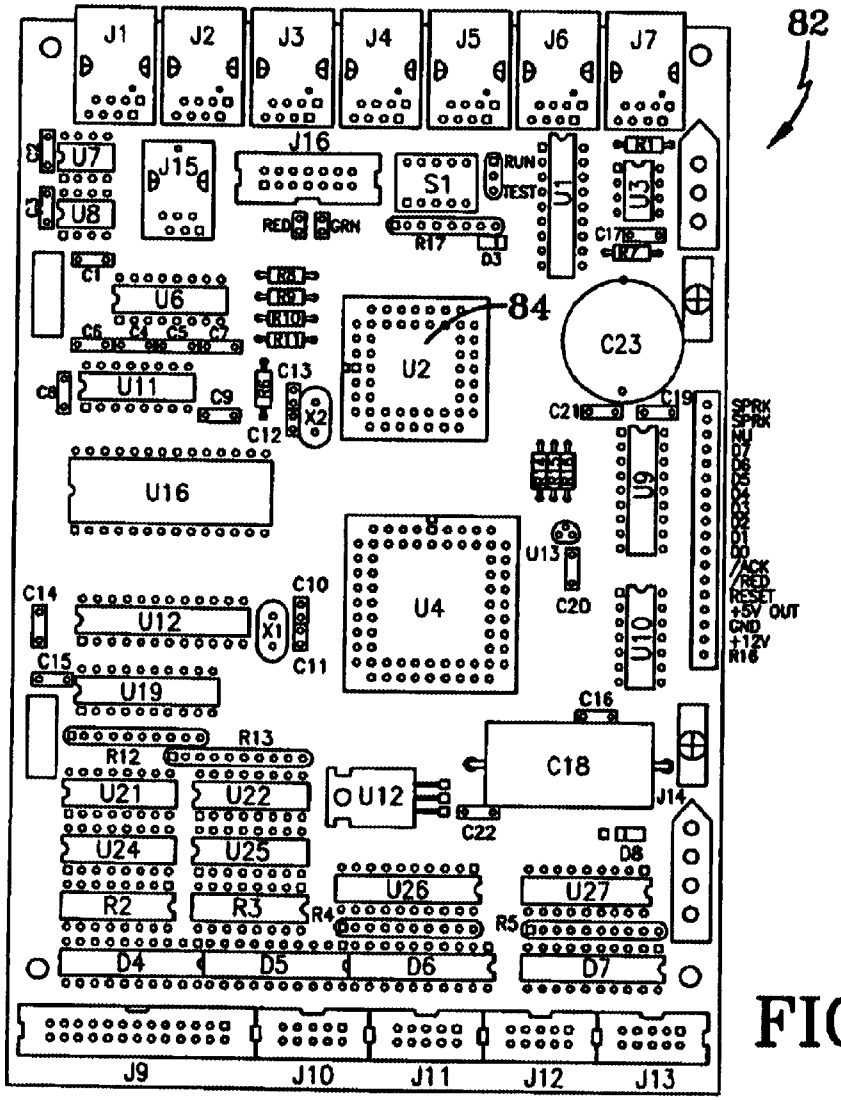
FIG. 5 illustrates one embodiment of a signal processing board of the present invention.

FIG. 5 illustrates one embodiment of a signal processing board 82 of the present invention. The board 82 may be based on a microcontroller or microprocessor system. For example, in the board 82 shown in FIG. 5, a 68HC11 Motorola chip 84 is used. The microcontroller may be programmed to achieve the purposes of the present invention. For example, a signal from the activation device (due to hitting the target) is received at the inputs of the processor board 82. The processor board 82 processes the signal and, among other things, sends a signal to actuate movement of the column 22. For example, the processor board 82 may send a signal to a driver board 86 which drives the motor 62.

Figure 6:
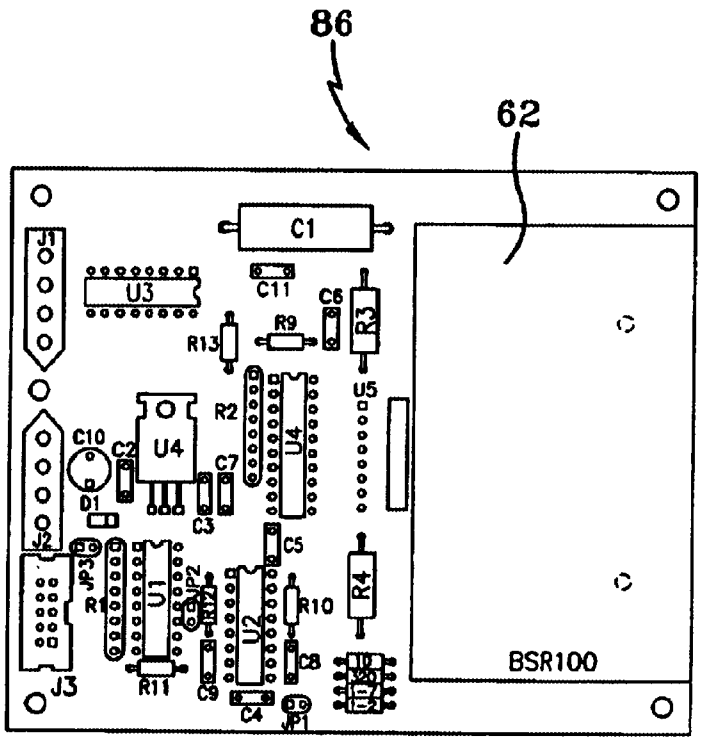
FIG. 6 illustrates one embodiment of a driver board of a rising column game of the present invention.

FIG. 6 illustrates one embodiment of the driver board 86 of the present invention. Although in the embodiment of FIGS. 5 and 6 the processor board 82 and driver board 86 are separate, in an alternate embodiment, they may be placed on one board.

In operation, multiple players seated at the consoles 14 of the game structure of FIG. 1 use water guns, or other projectile means, to actuate respective targets or actuation means. Hitting a target causes a corresponding column 22 to rise up in the vertical direction from a down position. In one embodiment, each of the columns 22 rise up through holes located in the cabinet 16 of the game structure. The first column 22 that reaches a predetermined level, e.g., an uppermost position, activates a detection means which causes actuation of a "winner" light located in relation to the column 22.

According to the present invention, the game structure or housing is pre-wired to accommodate the rising column embodiment just described as well as any other games the structure is intended to support (e.g., the rising column game with spinning platform, the rising water game, or the illuminating LED game).

Figure 7:
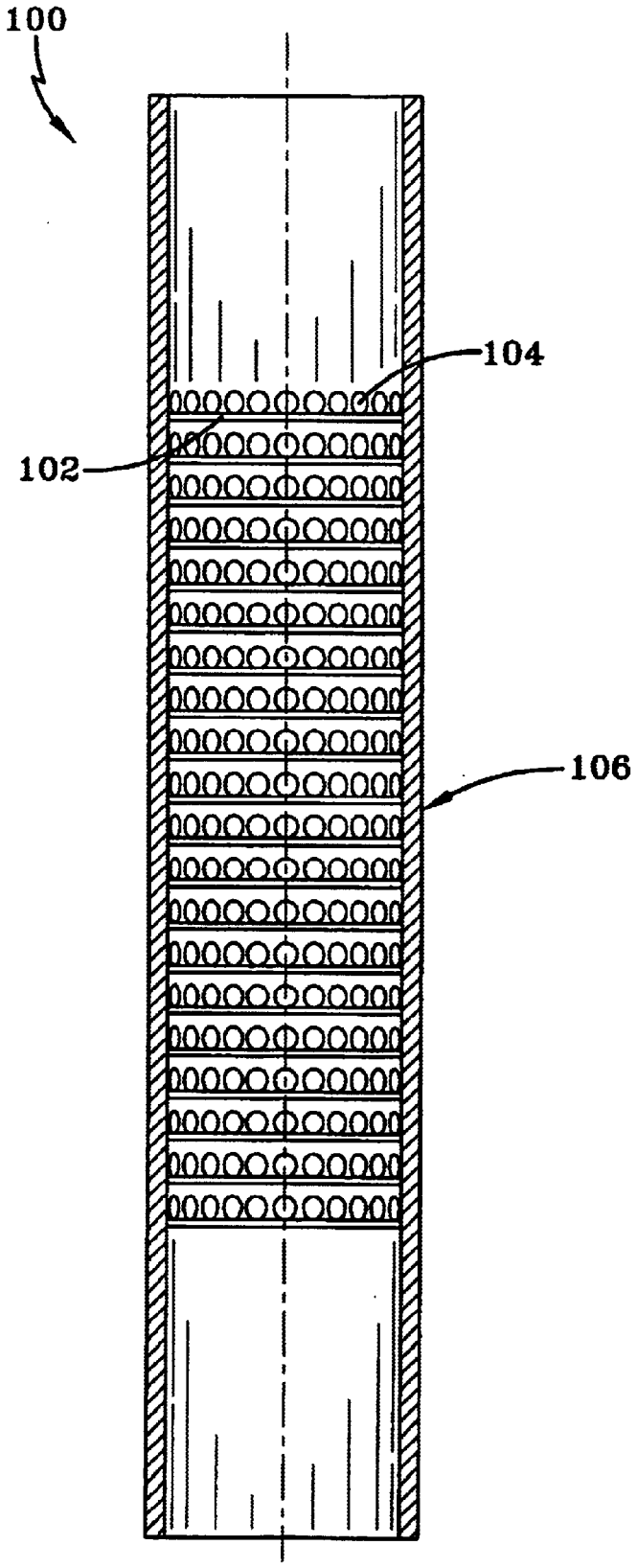
FIG. 7 illustrates one embodiment of a LED column of an illuminating LED race embodiment of the present invention.

Referring to FIG. 7, a preferred embodiment of the illuminating LED game consists of a stationary column 100 that is comprised of a tube 106. The tube 106 may be made of clear plastic or any other suitable transparent or translucent material. The tube 106 may have any suitable shape such as, but not limited to, round, square, rectangular, hexagonal, or any other desired polygonal shape. In the preferred embodiment, the tube 106 encases a stack of printed circuit boards 102 populated with LEDs 104 on the outer edges. There is preferably at least one LED 104 in each row. Each row of LEDs 104 preferably extends partially around the tube 106, e.g., around about half of the tube 106. However, it should be recognized that the LEDs 104 may extend completely around the tube 106, i.e., on all sides of the tube 106. In one embodiment, the LEDs 104 on the introductory piece alternate between red and yellow. Other color combinations may be used. Power may be conducted to the circuit boards 102 using metal stand-offs which also serve to evenly space the boards 104 along the length of the tube 106.

Multi-color LEDs 104 may be used to allow for enhanced graphic displays during "game attract" modes, i.e., modes configured to draw attention to the game. The boards can be programmed to light as a color unit to increase the graphic possibilities.

It should also be recognized that the LEDs 104 may be replaced by other types of lights. For example, the LEDs 104 may be replaced by light bulbs or lights that have an elongated shape. In such alternative embodiments, the lights may not be situated on printed circuit boards. The lights in these embodiments may be powered using conventional techniques.

The tubes 106 can be installed alternatively to, and in place of, the rising columns 20 or rising waters game column. The LEDs 104 are used as progress indicators during a race. The light boards 102 will preferably light sequentially until the last board (preferably at the top of the column 100) is lit. The first player to light all the boards wins. The system of the present invention may be programmed to display the word "WINNER" on the column via the LEDs 104 (preferably lengthwise down the column) to indicate the winner. The boards 102 can be programmed to rotate the word "WINNER" around the column 100 by selectively turning on and off the appropriate LEDs 104.

Figure 8:
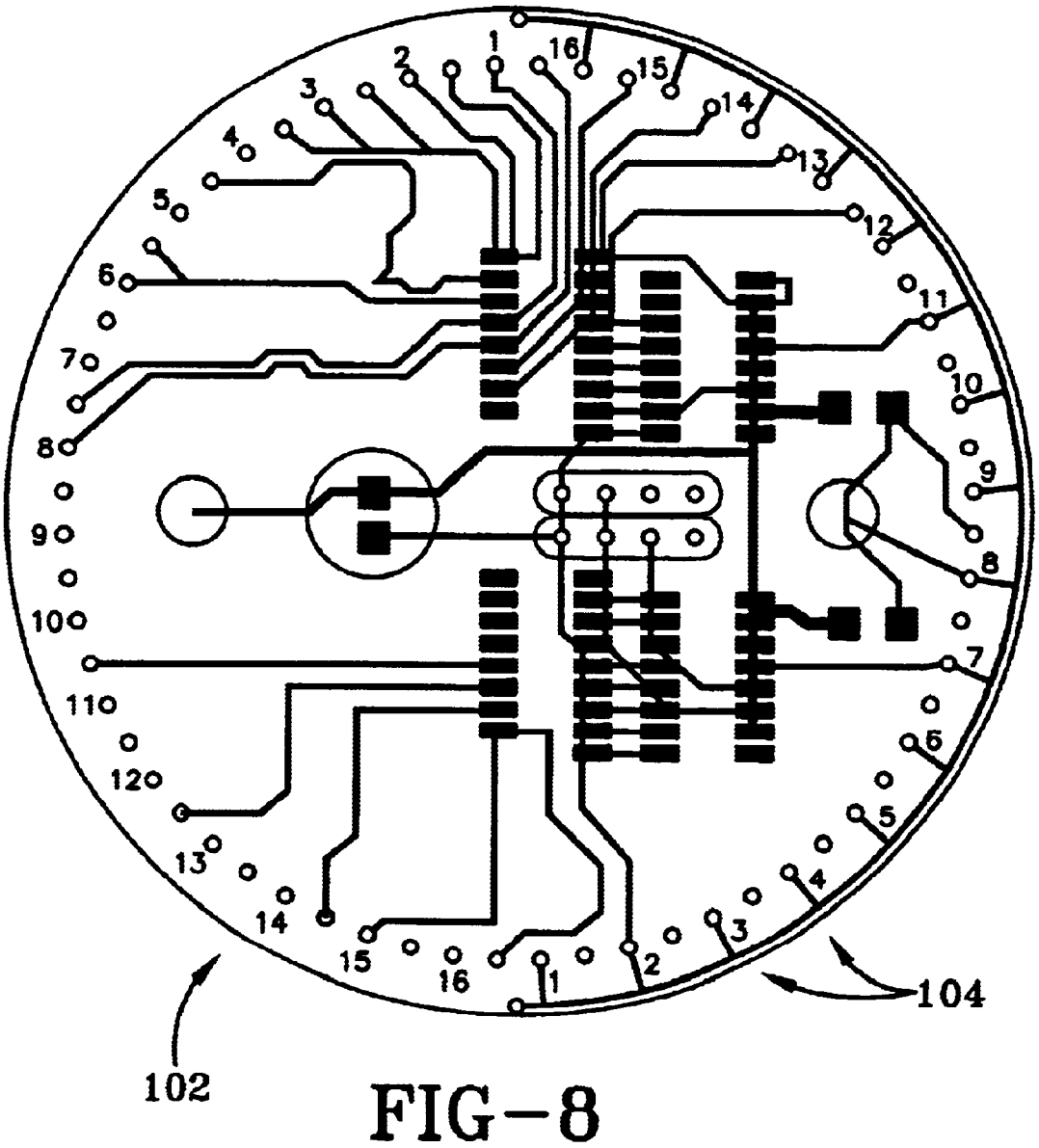
FIG. 8 illustrates a top plan view of one embodiment of a LED board of the present invention.
Figure 9:
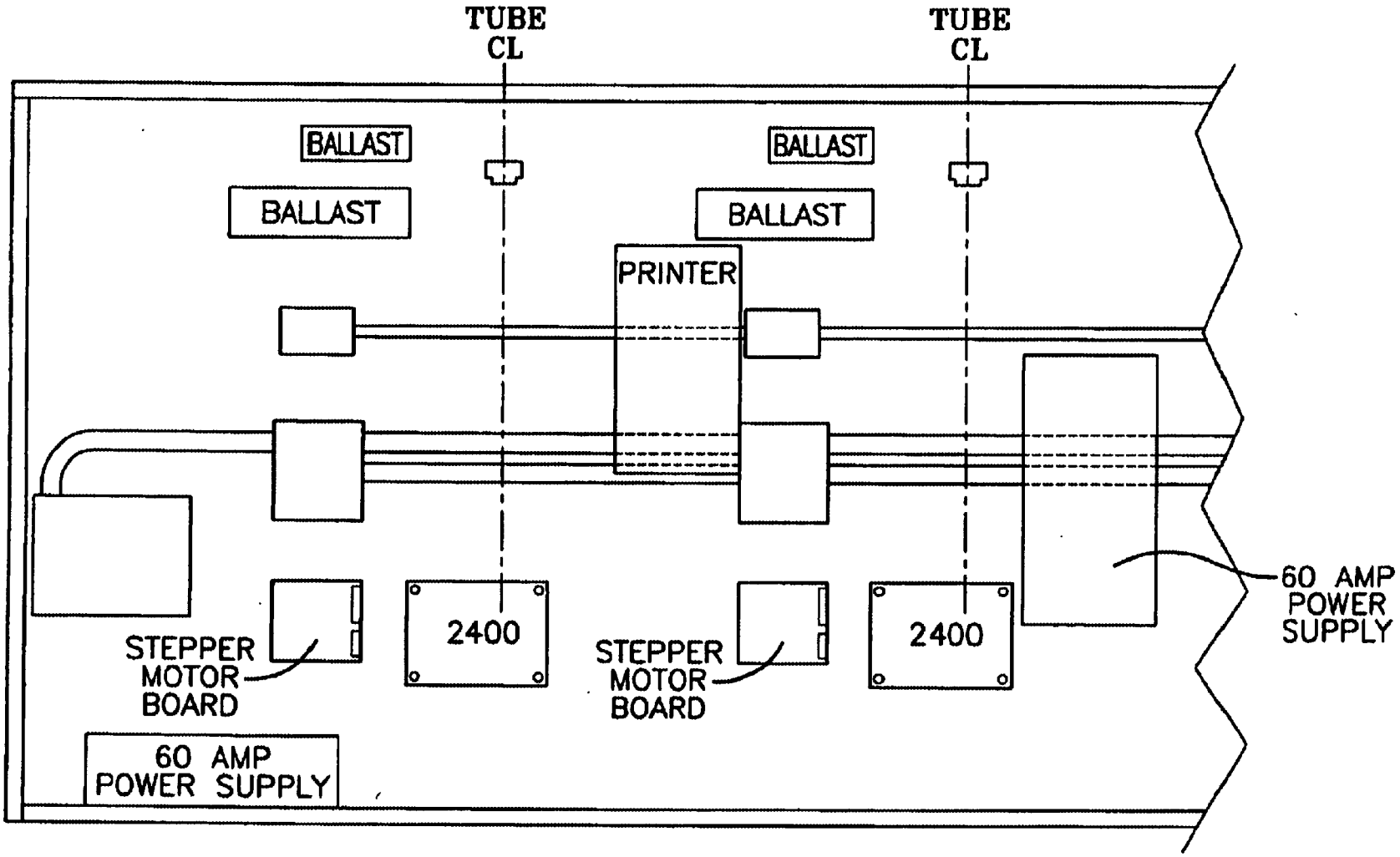
FIG. 9 illustrates a tank bank showing the ballast and stepper motor board placement of a preferred rising column game embodiment of the present invention.
Figure 10:
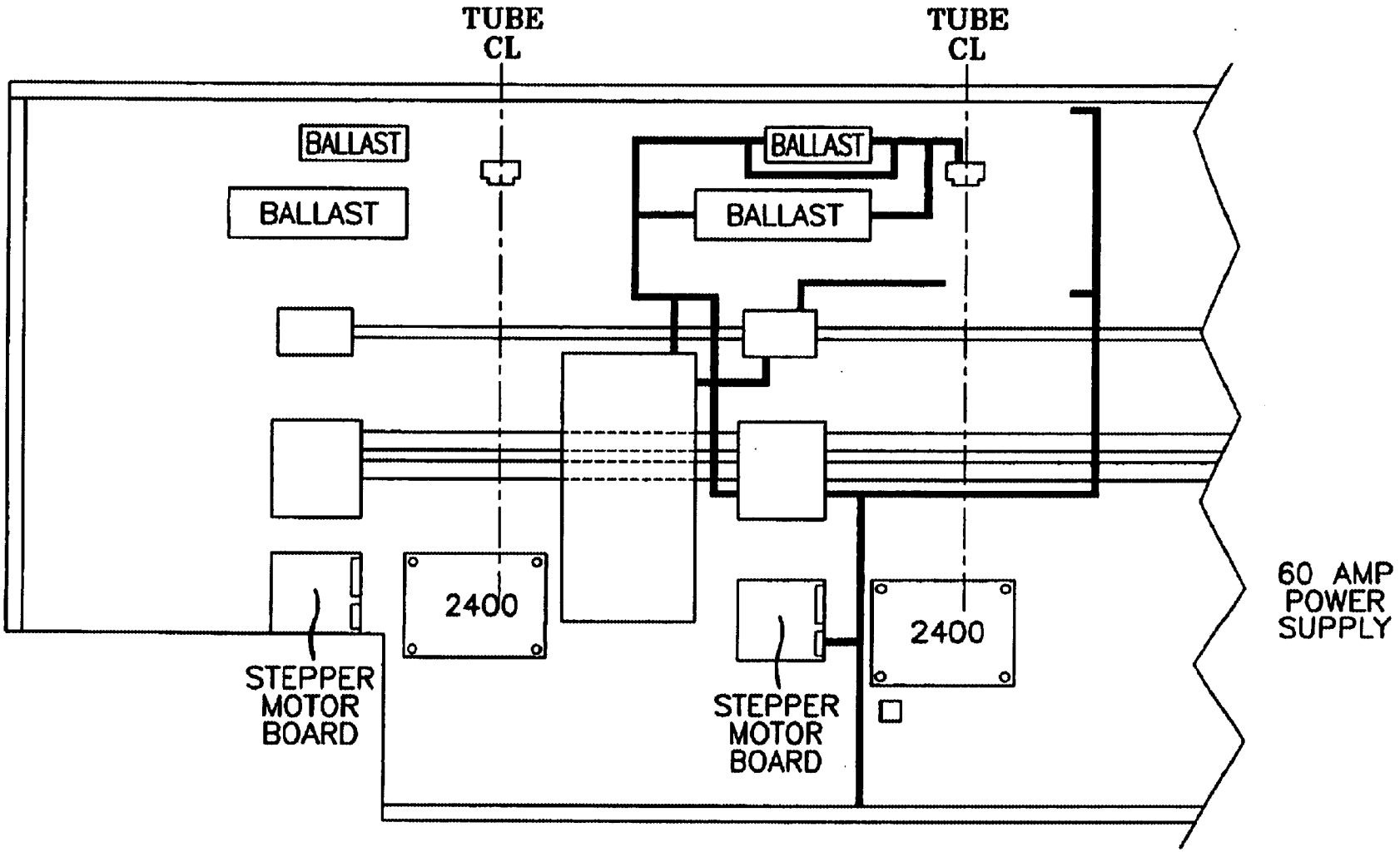
FIGS. 10 and 11 illustrate one embodiment of the wiring of an illuminating LED game embodiment of the present invention.
Figure 11:
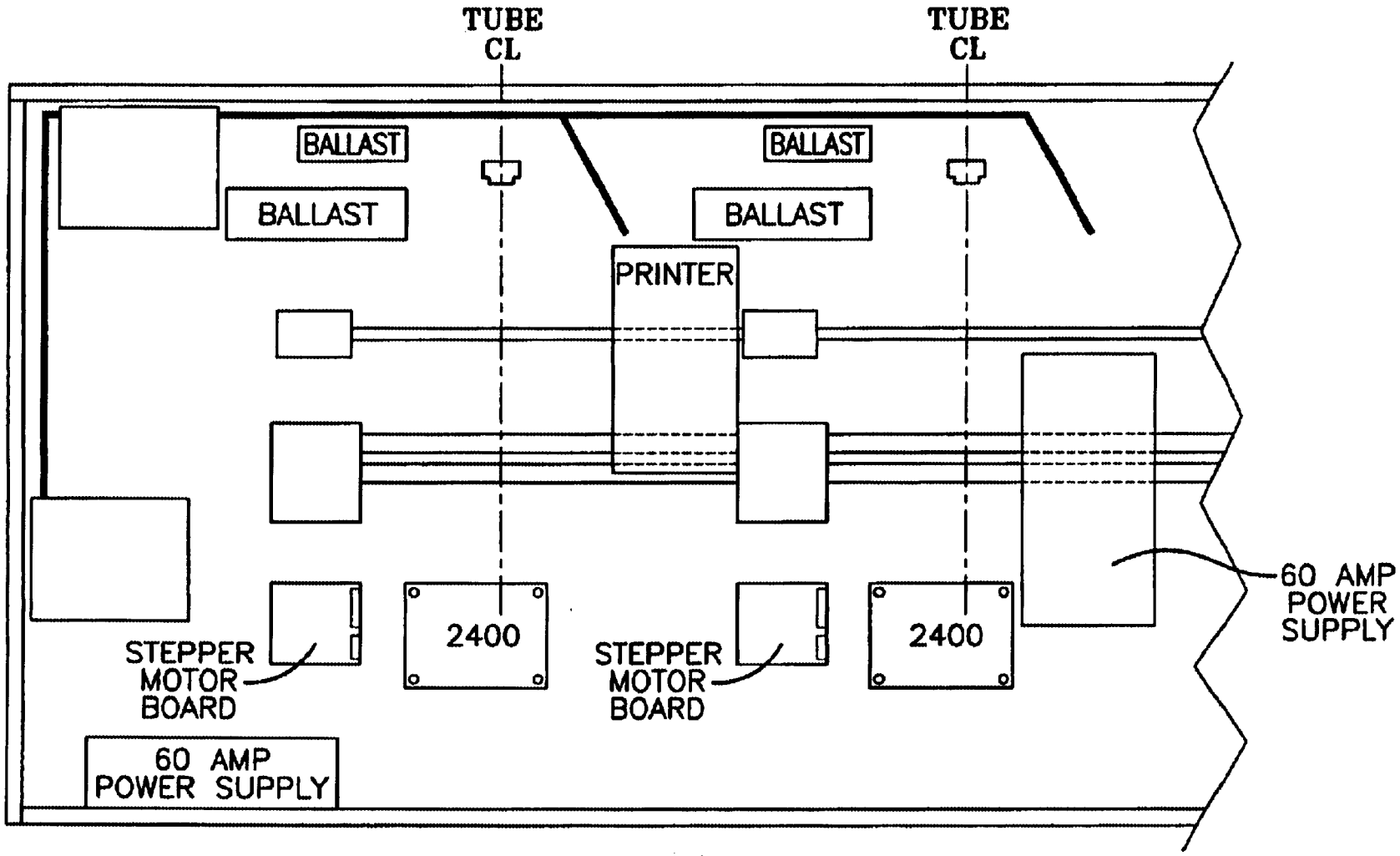

FIG. 8 illustrates a top plan view of one embodiment of the LED board 102 of the present invention. FIG. 9 illustrates a tank bank showing the ballast and stepper motor board placement for the present invention when used as the rising column game embodiment as previously described. When switching to the illuminating LED game embodiment, a ribbon cable is connected between the processing board (FIG. 5), e.g., a Bob's Space Racer 2400 board, and the LED board for controlling the actuation of the LEDs (see FIG. 10). A 60 Amp power supply is also connected to drive the lights (see FIG. 11). Furthermore, when switching from the rising column embodiment of FIG. 2 to the illuminating LED embodiment (where the column is stationary), the column of FIG. 2 is unscrewed or otherwise detached from the assembly 44 and a column 100 with encased LED circuit boards 102 is attached. The stepper motor may be disconnected in the illuminating LED game embodiment as the column 100 and platform are preferably stationary.

When switching from the rising column game format or LED game format to the rising water format, the respective tubes for those games are replaced with the water tube of the rising waters game which allows pumped water to rise up the tube to actuate a water level detection means to signal a winner. The water tube is connected to a pressurized water pump for driving water up the tube (this water pump is not used in the other non-water based game formats.)

Figure 12:
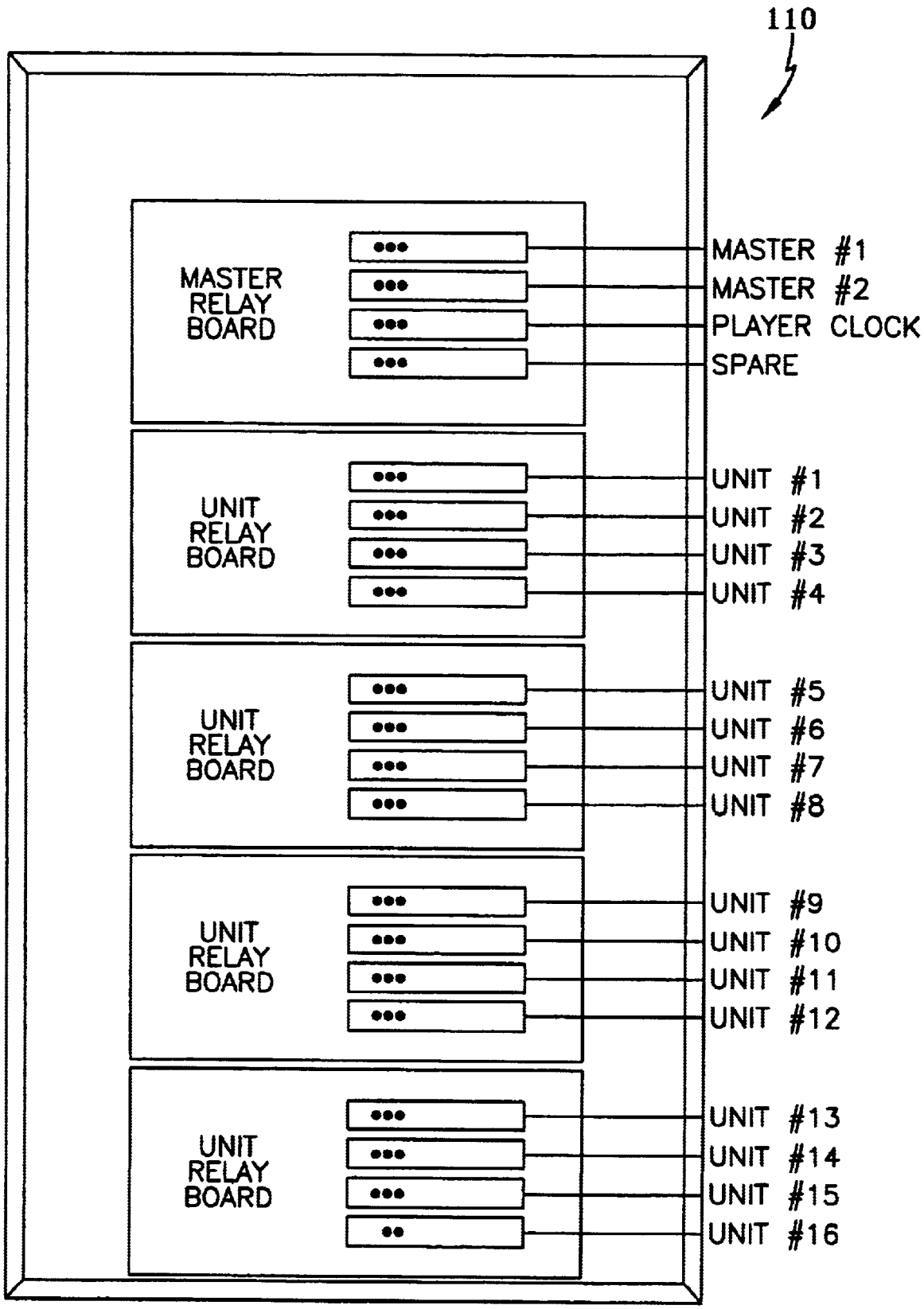
FIG. 12 illustrates one embodiment of a master controller with unit boards with modules to operate a plurality of game formats.
Figure 13:
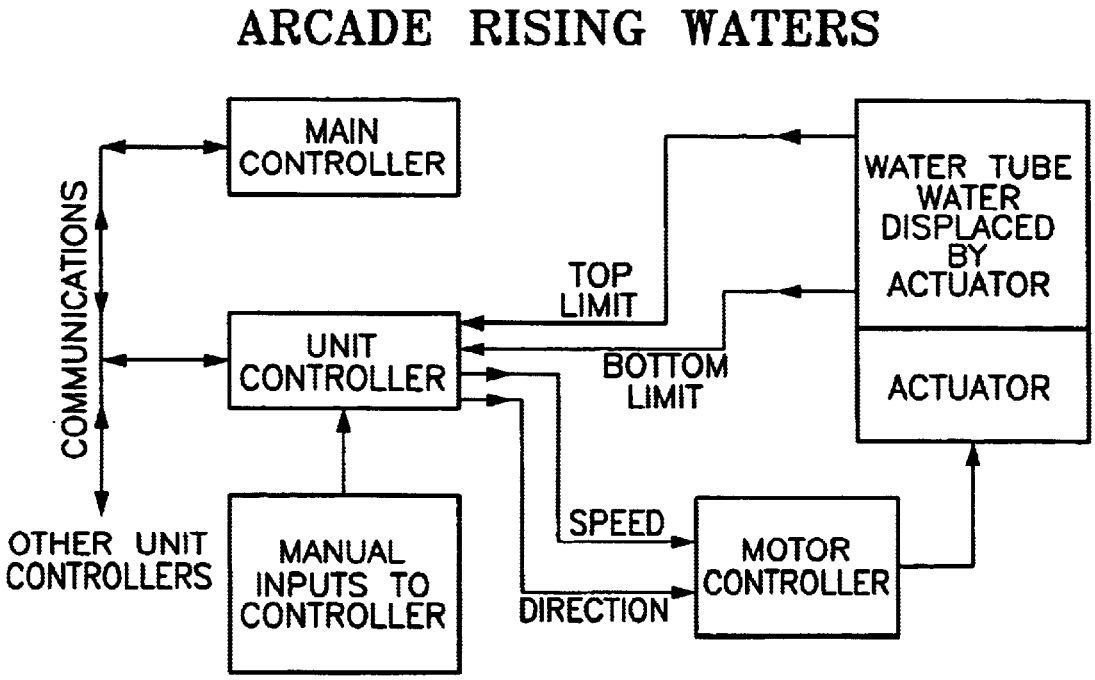
FIG. 13 illustrates a block diagram of the system of a preferred rising water game embodiment of the present invention.

When switching between game embodiments, a processor-based master unit is used to control the game formats for each embodiment. The master controller 110 is programmed with each game setting by setting register settings according to each game format. FIG. 12 illustrates one embodiment of the master controller 110 with unit boards with modules to operate a plurality of game formats. FIG. 13 shows connections of the master controller in the context of the rising water game format. When switching from one game format to another, the register settings are also switched to match the game format (e.g., how long to signal a winner, how many tickets to pay out, motor speed adjustments if any, when to start the water pump for the rising water embodiment, time to start the sound, etc.). It should also be appreciated that the processing means of FIG. 5, associated with each of the players' units, are programmed to accomplish the objectives of each game.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A game comprising:

a first modular projectile device adapted to shoot at least one projectile;

an activation device adapted to activate a signal when hit by said at least one projectile; and a racing game progression indication device in electrical communication with said activation device, said racing game progression indication device comprised of a plurality of lights, wherein said game is configured to cause said lights to emit light in succession in response to said signal; wherein illumination of said plurality of lights of said racing game progression indication device indicates a game player's advancement in said game, and wherein said first modular projectile device is adapted to be replaced with a second modular projectile device of a different type.

2. The game of claim 1 wherein said at least one projectile is selected from the group consisting of: fluids, solids, and light beams.

3. The game of claim 1 wherein said activation device is a switch.

4. The game of claim 1 wherein said activation device is selected from the group consisting of an electronic switch, a mechanical switch, an optical switch, a laser sensor, a pressure sensor, and an electrical contact.

5. The game of claim 1 wherein said lights of said racing game progression indication device are arranged in a column.

6. The game of claim 1 wherein:

said lights of said racing game progression indication device are arranged in a plurality of generally horizontal rows; and said rows are stacked in a generally vertical direction.

7. The game of claim 6 wherein said game is configured to cause said rows of said lights to emit light in succession in response to said signal.

8. The game of claim 1 wherein said lights are LEDs.

9. The game of claim 1 further comprising a processing system interposed between said activation device and said racing game progression indication device, said processing system adapted to control the lighting of said lights in response to said signal.

10. A game unit for playing a game, said game unit comprising:

at least one modular component, said modular component selected from the group consisting of: at least one projectile device, at least one activation device, at least one game progress indication device, and at least one winner indication device; and a base unit, wherein a first modular component is adapted to be removed from said base unit and subsequently replaced by a second modular component so as to modify said game.

11. The game unit according to claim 10, wherein said projectile device fires a projectile selected from the group consisting of: fluids, solids, and a light beam.

12. The game unit according to claim 10, wherein said projectile device is a gun selected from the group consisting of: laser guns, air guns, water guns, and projectile guns.

13. The game unit according to claim 10, wherein said activation device is selected from the group consisting of: electronic switches, mechanical switches, optical switches, laser sensors, pressure sensors, and electronic contacts.

14. The game unit according to claim 10, wherein said game progress indication device is a light array.

15. The game unit according to claim 10, wherein said winner indication device is selected from the group consisting of: flashing light arrays, alarms, sirens, spinning tops, glowing tops, and lighted LEDs.

16. The game unit according to claim 10, wherein said second modular component performs substantially the same function as said first modular component.

17. The game unit according to claim 10, wherein said second modular component performs a different function than said first modular component.

* * * * *